United States Patent [19]

Friedman et al.

[11] 3,950,129

[45] Apr. 13, 1976

[54] FLAME-RESISTANT WOOL

[75] Inventors: Mendel Friedman, Moraga; Willie Fong, Richmond, both of Calif.

[73] Assignee: The United States of America as represented by the Secretary of Agriculture, Washington, D.C.

[22] Filed: Oct. 19, 1973

[21] Appl. No.: 408,037

[52] U.S. Cl. ..... 8/17; 8/128 R
[51] Int. Cl.[2] ..... D06M 13/20; D06P 3/14
[58] Field of Search ..... 8/17, 128 R

[56] References Cited

UNITED STATES PATENTS

| | | | |
|---|---|---|---|
| 2,628,151 | 2/1953 | Walmsley et al. | 8/17 |
| 2,986,445 | 5/1961 | Koenig | 8/128 R |
| 3,305,297 | 2/1967 | Mantell et al. | 8/17 |
| 3,351,419 | 11/1967 | Fell et al. | 8/17 |
| 3,681,281 | 8/1972 | Juelke et al. | 8/171 |
| 3,753,650 | 8/1973 | Shimauchi et al. | 8/171 |
| 3,819,326 | 6/1974 | Shimauchi et al. | 8/171 |
| 3,867,095 | 2/1975 | Koenig et al. | 8/171 |

OTHER PUBLICATIONS

Friedman et al., Textile Research Journal, Vol. 43, No. 4, pp. 212–217, Apr. 1973.

*Primary Examiner*—Ronald W. Griffin
*Attorney, Agent, or Firm*—M. Howard Silverstein; William Takacs

[57] ABSTRACT

The flame resistance of wool is enhanced by treating it with chlorendic acid. The treatment is carried out in a manner similar to conventional dyeing, or in conjunction with dyeing. Typically, the wool is contacted with a hot aqueous medium containing chlorendic acid and a dye.

2 Claims, No Drawings

FLAME-RESISTANT WOOL

DESCRIPTION OF THE INVENTION

This invention relates to and has among its objects the provision of novel modified wool products which are particularly characterized by flame resistance. The objects of the invention also include novel methods for preparing these modified wool products. Further objects of the invention will be evident from the following description wherein parts and percentages are by weight unless otherwise specified.

Although wool does not ignite readily, flames will propagate in wool once ignition has occurred. A need, therefore, exists to flame-proof wool for many uses such as airplane upholstery, carpeting, blankets, sleepware, and the like. A particular aim of the invention is to fulfill this need.

It has been found in accordance with the invention that wool modified with chlorendic acid has the desirable characteristic of being flame resistant. Moreover, the flame-resistant property is retained despite laundering and dry-cleaning of the modified wool products. The durability of the modification achieved by the invention is believed to be due to the fact that the chlorendic acid is chemically adsorbed by the wool.

It is a particular advantage of the invention that the modification of wool with chlorendic acid is carried out in a manner just like conventional dyeing. In fact, a dyestuff may be incorporated in the treating bath whereby to attain both dyeing and enhancement of flame resistance.

Another valuable asset of the invention is that the modification does not impair the intrinsic properties of the wool. For example, the treatment does not impair the elasticity, hand, or tensile strength of the textile. The products of the invention are suitable for all the conventional uses of wool, such as the fabrication of carpeting, upholstery and drapery fabrics, garments, etc.

Chlorendic acid is a known compound having the structure

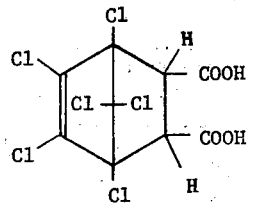

Its chemical name is 1,4,5,6,7,7-hexachlorobicyclo-(2.2.1)-5-heptene-2,3-dicarboxylic acid. Other names in addition to that and chlorendic acid are hexachloroendomethylenetetrahydrophthalic acid and HET acid.

In preparing flame-resistant wool in accordance with the invention, the following procedure is used: An aqueous solution of chlorendic acid is prepared. The concentration of chlorendic acid in the solution should be at least 8%, based on the weight of wool to be treated. Usually, a concentration of about 8 to 12%, based on the weight of wool, is used. The solution is heated and the wool entered therein. The solution is kept at the boil long enough for the chlorendic acid to react with the wool. This will generally be about 5 to 30 minutes, during which time essentially all the chlorendic acid in the solution will exhaust onto the wool and combine therewith. Following this, the treated wool is rinsed in water and dried and is ready for use or sale.

Since the modification of wool with chlorendic acid is performed under conditions like those used in dyeing, it is preferred to effectuate dyeing concomitantly with the flame-resist treatment. An unexpected result of the invention is that addition of chlorendic acid to a conventional dyebath does not adversely influence the level of dyeing. In other words, a given dyebath will yield the same level of dyeing with added chlorendic acid as it will yield in the absence of chlorendic acid. Thus in the preferred embodiment of the invention, one proceeds as in conventional dyeing with the additional point that chlorendic acid is incorporated in the dyebath. This has the advantage that a flame-resistant product is achieved by a minor modification of the usual dyeing operation.

Nothwithstanding incorporation of chlorendic acid in the dyebath, other factors in the dyeing operation are as in conventional dyeing. For example, wetting-out the fibers prior to dyeing, particular dye and adjuvants and the amounts thereof, temperature, and time of dyeing, etc. are selected in accordance with the usual principles of dyeing and thus may be varied over a wide range.

DETAILED DESCRIPTION OF THE INVENTION

In a preferred embodiment of the invention, the following steps are applied.

I. A dyebath is prepared and entered into a suitable vessel which may take the form of a dye beck, package dyeing machine, raw stock dyeing machine, beam dyeing machine, or the like. Typically, the dyebath is formulated by dissolving a dye and dyeing adjuvants in water. The dyeing adjuvants include sodium sulphate, sodium chloride, sulphuric acid, dispersing agents, and the like. To aid in dissolving the ingredients, the bath is heated, for example, to about 45°–50° C.

The total volume of dyebath will generally be about 10 to 50 parts thereof per part of wool. The amount of dye will vary depending on such factors as the nature of the dye, the physical state of the wool, and the level of dyeing desired. As the dye, one can use any of the water-soluble dyes useful for dyeing wool such as acid dyes, pre-metallized acid dyes, etc., all as well-known in the art.

II. The wool to be treated is entered into the dyebath which is then heated to boiling. It may be desired to wet-out the wool prior to entering it into the bath. The wool may be wet-out with water, or more preferably with water containing a small percentage (for example, about 0.01 to 0.05%) of a conventional wetting agent. Following entry of the wool, the dyebath is held at the boil long enough to permit exhaustion and leveling of the dyestuff.

III. Chlorendic acid is then added to the boiling dyebath. The amount of chlorendic acid used will depend on the nature of the wool textile being treated. Usually, excellent results are attained where one adds chlorendic acid in the amount of 8 to 12%, based on the weight of fiber (owf). Heating at 100° C. (or boiling) is continued for a period long enough to attain the desired uptake of chlorendic acid by the wool. In many cases, this will be about 5–30 minutes.

As in conventional dyeing, it is necessary to maintain intimate contact and relative motion between the fibers and the dyebath and this may be achieved by any suitable means such as stirring, rocking, tumbling, and the like, or by procedures that involve moving the wool about in the bath, or by circulating the bath through the mass of woolen fibers (as is the case with package dyeing machines).

The amount of chlorendic acid taken up by the wool may be varied by adjustment of such factors as the concentration of chlorendic acid in the dyebath, and the temperature and time of contact of the dyebath with the wool, and the pH of the bath. In general, the reaction conditions are so selected that the wool adsorbs about 8% (owf) of chlorendic acid. At such a level of uptake, satisfactory flame reistance is attained.

In an alternate, but less preferred, embodiment of the invention, chlorendic acid can be incorporated in the dyebath at the same time that the dye and other adjuvants are added. This particular embodiment of the invention, however, often yields less satisfactory flame resistance.

IV. After completion of Step III, the dyebath is drained out of the dyeing vessel. The wool is then rinsed with warm water to remove excess chemicals used in the treatment. Following the rinse, the treated goods are extracted and dried and are ready for use or sale.

V. The effluent liquors such as the spent dyebath and rinse liquors may be treated to recover the unused chlorendic acid therein. It is a special feature of the invention that this acid can be recovered conveniently. Chlorendic acid is only slightly soluble in cold water but very soluble in hot water. Thus, chlorendic acid is very soluble in the hot dyebath. However, after separation of the bath from the fibers, the bath can be cooled to ambient temperature, whereupon crystals of chlorendic acid are formed. The crystals are recovered by filtration, decantation, or the like, dried, and are ready for reuse in subsequent treatments. This feature of the invention not only provides economic advantages, but also aids in preventing pollution by recovering what otherwise would be discarded into waterways.

The invention has wide versatiliby and can be applied to woolen fibers in any physical condition, e.g., bulk fibers, top, sliver, rovings, yarns, webbing, woven or knitted textiles, felts, garments and garment parts.

EXAMPLES

The invention is further demonstrated by the following illustrative examples.

Flame tests were carried out according to the AATCC 34–1969 procedure published in AATCC Technical Manual, Vol. 48, pages 201–202 (1972). Ten specimens (3.5 × 10 in.), conditioned at 70° F., 65% RH, were exposed to a flame for 12 seconds. Five were exposed in the warp direction and five in the fill direction. Treatment is considered effective when the average char length is less than 7 inches, and the after-flame persists less than 12 seconds on the average after removal of the source.

EXAMPLE 1

A dyebath was prepared by compositing the following ingredients and heating to 49° C.:

| | |
|---|---|
| Glauber's salt | 10% (owf) |
| Sulphuric acid | 4% (owf) |
| Conventional dispersing agent | 1% (owf) |
| Dye mixture | 2% (owf) |
| Water | to make 1 liter |

The dye mixture contained 16 parts Calcofast Wool Yellow N (C.I. Acid yellow 54), 8 parts Neolan Blue 2R (C.I. acid blue 154), and 1 part Calcofast Wool Pink N (C.I. acid red 186).

A 25-gram wool swatch (plain weave woolen flannel, 6 oz./sq. yd., 10 × 20 in.) was entered into the dyebath which was then heated to boiling over a 20-minute period and boiling was continued for 10 minutes. Then, 8% (owf) of chlorendic acid was added. After boiling for 20 additional minutes, the fabric was removed from the solution, washed, and dried.

The so-treated wool swatch was cut into five 3.5 × 10 in. pieces, which were tested for flame resistance, in the warp direction, as described above.

The procedure as described above was repeated, and in this case the treated wool swatch was cut and tested, in the fill direction, for flame resistance.

Samples of the untreated wool were also tested for flame resistance. The results are tabulated below.

| Sample | After flame, sec. | | Char length, in. | |
|---|---|---|---|---|
| | Warp | Fill | Warp | Fill |
| Treated* | 3.5 | 5.2 | 4.3 | 4.8 |
| Untreated (control) | 30 | 29 | 10(total) | 10(total) |

*A portion of the product of this example was analyzed (by chlorine content) and found to contain 7.8% of chlorendic acid, based on the weight of wool.

Another sample of the product of this example was tested as follows: A swatch of the treated wool produced no evidence of irritation when taped for 24 hours to the denuded skin of the back of an adult Albino New Zealand rabbit. In addition, there was no evidence of irritation when a one sq. in. patch of the treated wool was taped to the inner forearm region of a human subject for 24 hours. After removal of the test swatch the skin area was kept under observation for 5 days. No sign of irritation was detected.

EXAMPLE 2

The experiment described in Example 1 was repeated except that the concentration of the dye mixture was varied. The results are tabulated below.

| Amount of dye mixture, % owf | After flame, sec. | | Char length, in. | |
|---|---|---|---|---|
| | Warp | Fill | Warp | Fill |
| 1.5 | 0.7 | 0.9 | 3.2 | 3.2 |
| 1.0 | 0.0 | 1.1 | 3.7 | 3.5 |
| 0.5 | 4.0 | 2.9 | 4.5 | 3.7 |
| 0.25 | 2.4 | 3.1 | 4.0 | 3.5 |
| 0.1 | 0.0 | 2.7 | 4.1 | 4.1 |

EXAMPLE 3

A dyebath was prepared by compositing the following ingredients and heating to 49° C.:

| | |
|---|---|
| Glauber's salt | 10% (owf) |
| Sulphuric acid | 4% (owf) |
| Conventional dispersing agent | 1% (owf) |
| Chrome Brown RLL (C.I. mordant brown 40) | 2% (owf) |
| Water | to make 1 liter |

A 25-gram wool swatch (plain weave woolen flannel, 6 oz./sq. yd., 10 × 20 in.) was entered into the dyebath which was then heated to the boil over a 20-minute period, and boiling was continued for 10 minutes. Then, 8% (owf) chlorendic acid was added. After boiling for 20 additional minutes, the fabric was removed from the solution, washed with water, and air dried.

For purpose of comparison, two additional runs were made as described above, except that in one instance the dye was omitted, in the other the chlorendic acid was omitted.

The products were tested as described above and the results are tabulated below.

| Run | Dye, % owf | Chlorendic acid, % owf | After flame, sec. | | Char length, in. | |
|---|---|---|---|---|---|---|
| | | | Warp | Fill | Warp | Fill |
| 1 | 2 | 8 | 5.3 | 6.7 | 5.0 | 4.5 |
| 2 | 0 | 8 | 5.8 | 5.5 | 4.5 | 5.0 |
| 3 | 2 | 0 | 30.2 | 27.3 | 10(Total) | 10(Total) |

The products of runs 1 and 3 were examined and found to have the same level of color. This indicated that the addition of chlorendic acid to the dyebath did not adversely affect the dyeing result of the treatment.

Having thus described the invention, what is claimed is:

1. A process for modifying wool to make it flame resistant, which comprises contacting the wool with an aqueous solution containing about from 8 to 12%, owf, of chlorendic acid at 100° C., the contacting being continued until the wool adsorbs about 8%, based on the weight of wool, of chlorendic acid.

2. A process for concomitantly dyeing wool and for modifying the wool to make it flame resistant, which comprises a. providing an aqueous dyebath containing a wool dye, b. entering the wool into the dyebath and heating it to the boiling point, c. adding chlorendic acid in the amount of about 8 to 12%, based on the weight of wool, to the dyebath, and continuing the boiling until the wool adsorbs about 8%, based on the weight of wool, of chlorendic acid, d. removing the treated wool from the dyebath, then rinsing and drying it.

* * * * *